US011129761B2

(12) United States Patent
Oberle, Sr. et al.

(10) Patent No.: US 11,129,761 B2
(45) **Date of Patent: *Sep. 28, 2021**

(54) MODULAR ADJUSTABLE BED SYSTEM FACILITATING ASSEMBLY IN A MANUAL, PARTIALLY-ELECTRIC, OR FULLY-ELECTRIC CONFIGURATION

(71) Applicant: Drive DeVilbiss Healthcare, Port Washington, NY (US)

(72) Inventors: Joseph F. Oberle, Sr., Greenlawn, NY (US); Barry Fink, Brooklyn, NY (US)

(73) Assignee: Drive DeVilbiss Healthcare, Port Washington, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/772,417

(22) PCT Filed: Sep. 25, 2019

(86) PCT No.: PCT/US2019/052948
§ 371 (c)(1),
(2) Date: Jun. 12, 2020

(87) PCT Pub. No.: WO2020/068975
PCT Pub. Date: Apr. 2, 2020

(65) Prior Publication Data

US 2021/0205159 A1 Jul. 8, 2021

Related U.S. Application Data

(60) Provisional application No. 62/738,430, filed on Sep. 28, 2018.

(51) Int. Cl.
*A61G 7/015* (2006.01)
*A61G 7/018* (2006.01)

(52) U.S. Cl.
CPC ..... *A61G 7/015* (2013.01); *A61G 7/018* (2013.01)

(58) Field of Classification Search
CPC ..... A61G 7/015; A61G 7/018
See application file for complete search history.

(56) References Cited

U.S. PATENT DOCUMENTS 4,120,057 A * 10/1978 Neumann ..... A47C 20/041 5/616
4,970,737 A 11/1990 Sagel
(Continued)

OTHER PUBLICATIONS

International Search Report and Written Opinion issued in corresponding International Application No. PCT/US2019/052948 dated Nov. 26, 2019, 11 pages.

*Primary Examiner* — Eric J Kurilla
(74) *Attorney, Agent, or Firm* — Carter, DeLuca & Farrell LLP

(57) ABSTRACT

A bed system includes a fixed frame, a movable frame, and first and second end boards disposed at the head and foot ends of the fixed frame, respectively. The system may be assembled and/or configured such that: a first electric or manual actuator is coupled between the fixed frame assembly and a first linkage assembly of the movable frame assembly for powered or manual movement of a first movable section of the movable frame assembly; a second electric or manual actuator is coupled between the fixed frame assembly and a second linkage assembly for powered or manual movement of a second movable section of the movable frame assembly; and/or a third electric or manual actuator is coupled between the first and second end boards for powered or manual height adjustment of the head and foot ends of the fixed frame assembly.

26 Claims, 9 Drawing Sheets

(56) References Cited

U.S. PATENT DOCUMENTS

| | | | | |
|---|---|---|---|---|
| 5,095,562 | A | 3/1992 | Alexander | |
| 6,276,011 | B1 | 8/2001 | Antinori | |
| 6,826,793 | B2 | 12/2004 | Tekulve | |
| 8,418,283 | B2 | 4/2013 | Serhan et al. | |
| 8,424,135 | B2 | 4/2013 | Serhan | |
| 8,800,080 | B2 | 8/2014 | Kay et al. | |
| 2002/0036421 | A1* | 3/2002 | Bangert | A47C 20/041 297/316 |
| 2015/0143934 | A1* | 5/2015 | Wu | A47C 20/041 74/89.29 |
| 2016/0361216 | A1* | 12/2016 | Liu | A61G 7/015 |
| 2018/0360681 | A1* | 12/2018 | Paul | A61G 7/015 |
| 2019/0198168 | A1* | 6/2019 | Lee | G16H 40/63 |
| 2020/0078238 | A1* | 3/2020 | Huang | A61G 7/018 |

* cited by examiner

MODULAR ADJUSTABLE BED SYSTEM FACILITATING ASSEMBLY IN A MANUAL, PARTIALLY-ELECTRIC, OR FULLY-ELECTRIC CONFIGURATION

CROSS-REFERENCE TO RELATED APPLICATIONS

This application is a U.S. National Stage Application under 35 U.S.C. § 371(a) of PCT/US19/52948, filed on Sep. 25, 2019, which claims the benefit of, and priority to, U.S. Provisional Patent Application No. 62/738,430, filed on Sep. 28, 2018, the entire contents of which is hereby incorporated herein by reference.

BACKGROUND

1. Technical Field

The present disclosure relates to an adjustable bed system, and more particularly, to a modular adjustable bed system facilitating assembly in a manual, partially-electric, or fully-electric configuration.

2. Background of Related Art

Adjustable beds are often used in both home care and in more formalized medical settings, e.g., hospice facilities, hospitals, etc. Adjustable beds generally include a pair of end boards, e.g., a headboard and a footboard, a fixed bed frame that extends between the end boards, and a movable bed frame mounted on the fixed bed frame and configured to support a mattress thereon. Depending upon the particular configuration of the bed, height adjustment of the fixed bed frame relative to the end boards, articulation of the head end of the movable bed frame relative to the fixed bed frame, and/or articulation of the foot end of the movable bed frame relative to the fixed bed frame may be accomplished via a manual mechanism, e.g., a gear crank, or may be accomplished by a powered mechanism, e.g., an electric motor actuator.

The particular configuration of the adjustable bed, e.g., manual, partially-electric, or fully-electric, may depend upon the location the bed is to be used, patient needs and limitations, caregiver needs and limitations, cost considerations, and/or other factors. It would therefore be desirable to provide a modular adjustable bed system facilitating assembly in a manual, partially-electric, or fully-electric configuration, thereby readily enabling customization for a particular purpose.

SUMMARY

The present disclosure provides a modular adjustable bed system facilitating assembly in a manual, partially-electric, or fully-electric configuration. The modular adjustable bed system of the present disclosure thus readily enables customization of an adjustable bed for a particular purpose without requiring complex assembly or specialized manufacturing for each particular configuration of bed. In aspects, assembly and dis-assembly of actuators may be performed without the need for tools. To the extent consistent, any of the aspects and features detailed herein may be utilized with any or all of the other aspects and features detailed herein.

In aspects of the present disclosure, a modular adjustable bed system is provided including a fixed frame assembly defining a head end and a foot end, a movable frame assembly disposed on the fixed frame assembly and including at least first and second movable sections movable relative to the fixed frame assembly, first and second linkage assemblies operably coupled to the first and second movable sections, respectively, a first end board disposed at the head end of the fixed frame assembly and operably coupled thereto to enable height adjustment of the head end of the fixed frame assembly, a second end board disposed at the foot end of the fixed frame assembly and operably coupled thereto to enable height adjustment of the foot end of the fixed frame assembly, and a transmission assembly interconnecting the first and second end boards such that height adjustment of one of the head end or the foot end effects similar height adjustment of the other of the head end or the foot end.

The modular adjustable bed system is configured for assembly in a variety of configurations including each of the following combinations: wherein a first electric actuator is coupled between the fixed frame assembly and the first linkage assembly for powered movement of the first movable section relative to the fixed frame assembly or wherein a first manual actuator is coupled between the fixed frame assembly and the first linkage assembly for manual movement of the first movable section relative to the fixed frame assembly; wherein a second electric actuator is coupled between the fixed frame assembly and the second linkage assembly for powered movement of the second movable section relative to the fixed frame assembly or wherein a second manual actuator is coupled between the fixed frame assembly and the second linkage assembly for manual movement of the second movable section relative to the fixed frame assembly; and wherein a third electric actuator is coupled between the transmission assembly and one of the first or second end boards for powered height adjustment of the head and foot ends of the fixed frame assembly or wherein a third manual actuator is coupled between the transmission assembly and one of the first or second end boards for manual height adjustment of the head and foot ends of the fixed frame assembly.

A method of assembling a modular adjustable bed system is also provided in accordance with aspects of the present disclosure. The method includes assembling a fixed frame assembly, a movable frame on the fixed frame assembly, a first end board at a head end of the fixed frame assembly, and a second end board at a foot end of the fixed frame assembly. The method further includes various determinations including determining whether powered movement or manual movement of a first movable section of the movable frame relative to the fixed frame assembly is desired, determining whether powered movement or manual movement of a second movable section of the movable frame relative to the fixed frame assembly is desired, and determining whether powered height adjustment of the fixed frame assembly or manual height adjustment of the fixed frame assembly is desired.

With respect to the first movable section, if powered movement of the first movable section is desired, the method further includes operably coupling a first electric actuator between the fixed frame assembly and a first linkage assembly of the movable frame assembly for powered movement of the first movable section relative to the fixed frame assembly. If manual movement of the first movable section is desired, the method instead includes operably coupling a first manual actuator between the fixed frame assembly and the first linkage assembly of the movable frame assembly for manual movement of the first movable section relative to the fixed frame assembly.

With respect to the second movable section, if powered movement of the second movable section is desired, the method further includes operably coupling a second electric actuator between the fixed frame assembly and a second linkage assembly of the movable frame assembly for powered movement of the second movable section relative to the fixed frame assembly. If manual movement of the second movable section is desired, the method instead includes operably coupling a second manual actuator between the fixed frame assembly and the second linkage assembly of the movable frame assembly for manual movement of the second movable section relative to the fixed frame assembly.

With respect to height adjustment, if powered height adjustment of the fixed frame assembly is desired, the method further includes operably coupling a third electric actuator between the first and second end boards for powered height adjustment. If powered height adjustment of the fixed frame assembly is desired, the method instead includes operably coupling a third manual actuator between the first and second end boards for manual height adjustment.

A modular adjustable bed system provided in accordance with aspects of the present disclosure includes a fixed frame assembly defining a head end and a foot end, a movable frame assembly disposed on the fixed frame assembly and including at least a first movable section movable relative to the fixed frame assembly, and a first linkage assembly operably coupled to the first movable section such that actuation of the first linkage assembly moves the first movable section relative to the fixed frame assembly. The first linkage assembly is configured to releasably connect to at least two different types of first actuators to enable each of the at least two different types of first actuators to actuate the first linkage assembly, thereby moving the first movable section relative to the fixed frame assembly.

In an aspect of the present disclosure, the first linkage assembly includes a frame having first and second connectors extending therefrom. The first connector is configured to connect to at least a first type of first actuator and the second connector is configured to connect to at least a second type of first actuator.

In another aspect of the present disclosure, at least the first type of first actuator is configured for engagement between the first connector and the fixed frame assembly.

In another aspect of the present disclosure, the first linkage assembly further includes at least one linkage arm coupled between the frame and the first movable section of the movable frame assembly.

In yet another aspect of the present disclosure, the frame of the first linkage assembly includes a carriage bar and a pair of upright supports extending from the carriage bar to define a U-shaped configuration.

In still another aspect of the present disclosure, the carriage bar is configured to slide along tracks defined within the fixed frame assembly.

In still yet another aspect of the present disclosure, the first and second connectors extend from the carriage bar.

In another aspect of the present disclosure, the two different types of first actuators include different types of engagement mechanisms. In such aspects, one of the two different types of first actuators is configured for pin-hole engagement with the first linkage assembly and another of the two different types of first actuators is configured for post-channel engagement with the first linkage assembly.

In another aspect of the present disclosure, one of the two different types of first actuators is an electric actuator and another of the two different types of first actuators is a manual actuator. Alternatively, one of the two different types of first actuators is a first electric actuator and another of the two different types of first actuators is a second, different electric actuator In an aspect of the present disclosure, the system further includes a first a first end board disposed at the head end of the fixed frame assembly and operably coupled thereto to enable height adjustment of the head end of the fixed frame assembly, a second end board disposed at the foot end of the fixed frame assembly and operably coupled thereto to enable height adjustment of the foot end of the fixed frame assembly, and a transmission assembly interconnecting the first and second end boards such that height adjustment of one of the head end or the foot end effects similar height adjustment of the other of the head end or the foot end.

In another aspect of the present disclosure, wherein at least two different types of height adjustment actuators are configured to couple between the transmission assembly and one of the first or second end boards for height adjustment of the head and foot ends of the fixed frame assembly. The at least two different types of height adjustment actuators may include an electric height adjustment actuator and a manual height adjustment actuator.

In still another aspect of the present disclosure, the movable frame assembly includes a second movable section movable relative to the fixed frame assembly. In such aspects, the system may further include a second linkage assembly operably coupled to the second movable section such that actuation of the second linkage assembly moves the second movable section relative to the fixed frame assembly. The second linkage assembly is configured to releasably connect to at least two different types of second actuators to enable each of the at least two different types of second actuators to actuate the second linkage assembly, thereby moving the second movable section relative to the fixed frame assembly.

In yet another aspect of the present disclosure, the second linkage assembly includes a frame having first and second connectors extending therefrom. The first connector is configured to connect to at least a first type of second actuator and the second connector is configured to connect to at least a second type of second actuator.

In still yet another aspect of the present disclosure, at least one type of first actuator and at least one type of second actuator are separate from one another. Alternatively or additionally, at least one type of first actuator and at least one type of second actuator are coupled together as an actuator assembly.

BRIEF DESCRIPTION OF THE DRAWINGS

Aspects and features of the presently disclosed modular adjustable bed system are described herein below with reference to the accompanying drawings, wherein.

DETAILED DESCRIPTION

Figure 1:
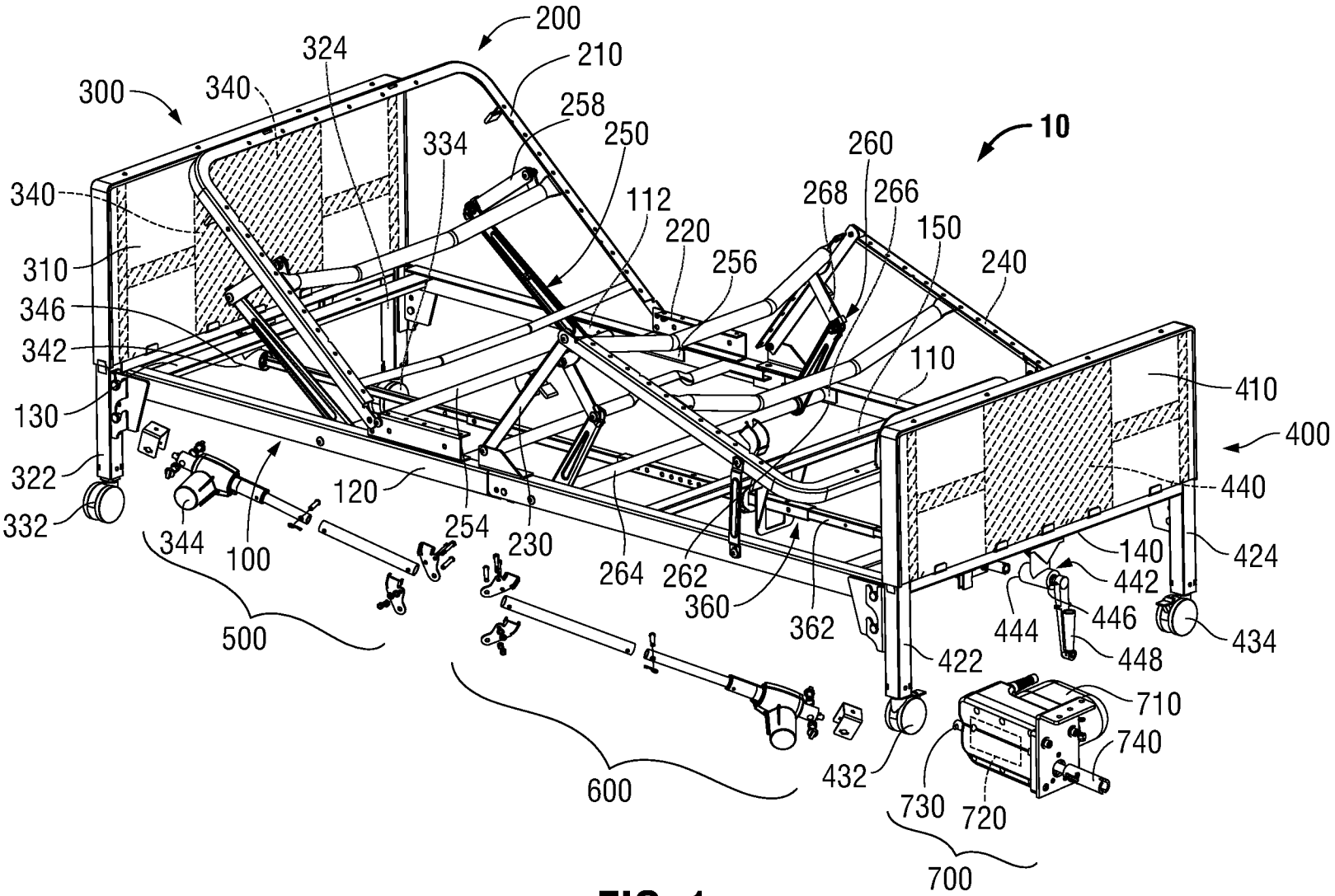
FIG. 1 is an exploded, perspective view of a modular adjustable bed system provided in accordance with the present disclosure, illustrated in a fully electric configuration.

Various aspects and features of the present disclosure are detailed below with reference to the drawings wherein like references characters identify similar or identical elements. More specifically, turning to FIGS. 1 and 2, a modular adjustable bed system provided in accordance with the present disclosure is generally identified by reference numeral 10. System 10 includes a fixed frame assembly 100, a movable frame assembly 200, first and second end boards 300, 400, and a plurality of adjustment assemblies 500, 600, 700, 800 (FIGS. 5-7), and 900 (FIG. 8), which, as detailed below, may be manually-operated or electrically-powered, thus enabling modular adjustable bed system 10 to define a manual configuration, partially-electric configuration, or fully-electric configuration.

Fixed frame assembly 100 includes first and second side rails 110, 120; first and second end rails 130, 140; and one or more cross-rails 150. Side rails 110, 120; end rails 130, 140; and cross-rail(s) 150 are affixed to one another, e.g., using bolts or other suitable fasteners, to form fixed frame assembly 100 defining a generally rectangular configuration having relatively longer sides (defined by side rails 110, 120) and relatively narrower ends (defined by end rails 130, 140). The one or more cross-rails 150 extend between side rails 110, 120 and are positioned between end rails 130, 140. Side rails 110, 120 each define a slide track 112 (only slide track 112 of side rail 110 is illustrated, the slide track of side rail 110 is similar) on the inwardly-facing side thereof. The slide tracks 112 are configured, as detailed below, to facilitate articulation of movable frame assembly 200 relative to fixed frame assembly 100.

Figure 2:
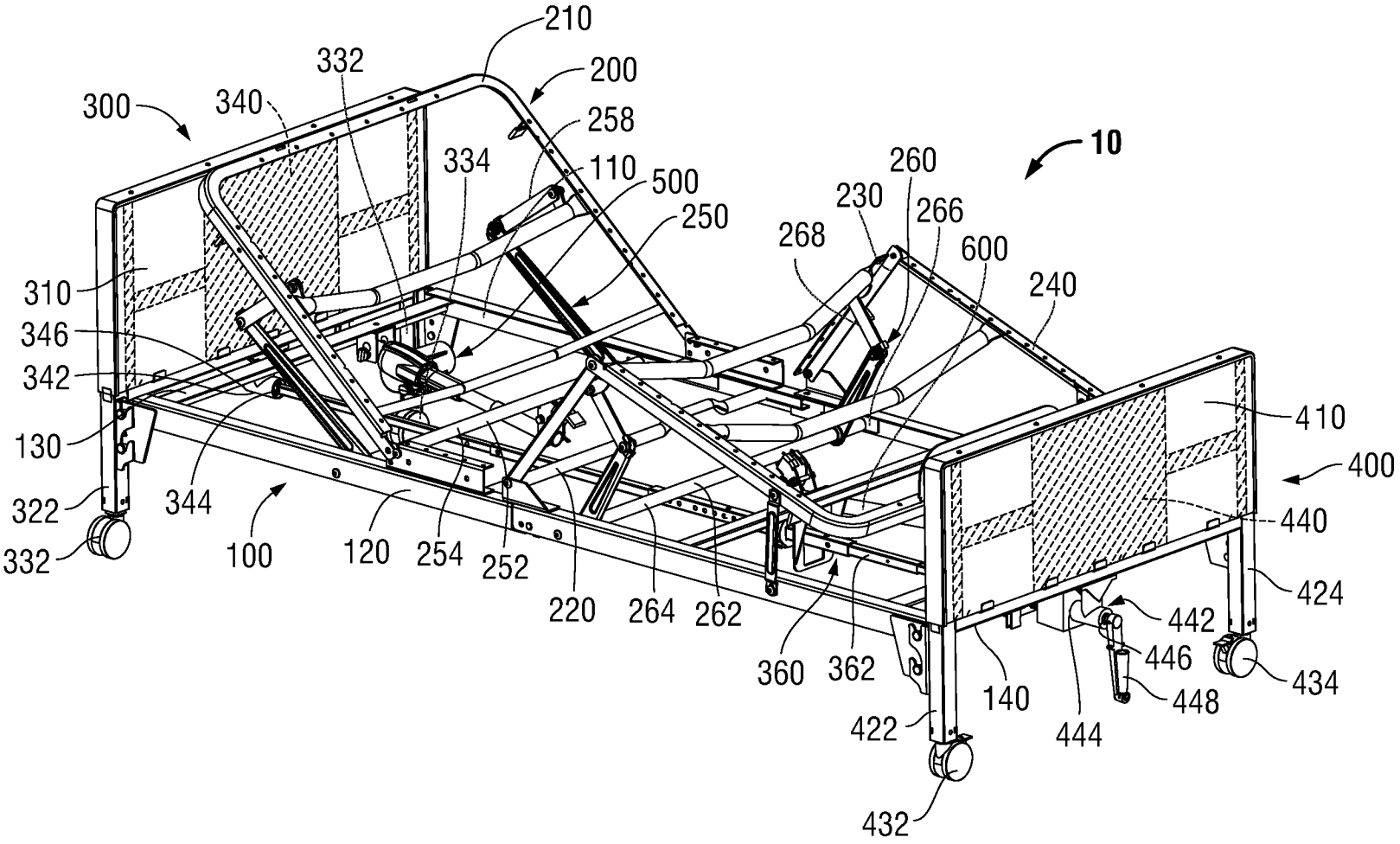
FIG. 2 is a perspective view of the modular adjustable bed system of FIG. 1, illustrated in the fully electric configuration.

Continuing with reference to FIGS. 1 and 2, movable frame assembly 200 includes a plurality of sections 210, 220, 230, 240 pivotably coupled to one another and/or fixed frame assembly 100 to enable movement at least between a substantially flat or lying position, a seated position, a legs raised position, and a seated and legs raised position. Movable frame assembly 200, more specifically, includes a back section 210, a hip section 220, a thigh section 230, and a lower leg section 240, although greater or fewer than four (4) sections and/or different configurations of sections 210-240 are also contemplated. Hip section 220 is fixedly secured to fixed frame assembly 100. Back section 210 is pivotably coupled to hip section 220 about a fixed pivot axis relative to fixed frame assembly 100 and extends therefrom towards the head end of fixed frame assembly 100. Thigh section 230 is pivotably also coupled to hip section 220 about a fixed pivot axis relative to fixed frame assembly 100 and extends therefrom towards the foot end of fixed frame assembly 100. Foot section 240 is pivotably coupled to thigh section 230 and extends therefrom towards the foot end of fixed frame assembly 100. Foot section 240, more specifically, is pivotably coupled to thigh section 230 about a pivot axis that is movable relative to fixed frame assembly 100 such that foot section 240 is both pivotable and longitudinally movable relative fixed frame assembly 100, e.g., in response to pivoting of thigh section 230 relative to fixed frame assembly 100.

Movable frame assembly 200 further includes a first linkage assembly 250 and a second linkage assembly 260. First linkage assembly 250 includes a slide carriage including a carriage bar 254 having first and second slide feet 256 (only one slide foot 256 is illustrated) slidably engaged within slide tracks 112 of side rails 110, 120 of fixed frame assembly 100, thus enabling carriage bar 254 to slide longitudinally along fixed frame assembly 100. First linkage assembly 250 further includes one or more linkage arms 258 pivotably coupling carriage bar 254 to back section 210 of movable frame assembly 200 at a position offset from the pivot axis of back section 210 such that sliding of carriage bar 254 longitudinally along fixed frame assembly 100 pivots the one or more linkage arms 258 to thereby articulate back section 210 relative to fixed frame assembly 100. In embodiments, first linkage assembly 250 includes a pair of linkage arms 258, one linkage arm disposed towards each side thereof; in other embodiments linkage arms 258 are omitted and first linkage assembly 250 is directly pivotably coupled to back section 210. Further, in embodiments, first linkage assembly 250 is configured to articulate back section 210 relative to fixed frame assembly 100 without including carriage bar 254 slidably engaged within slide tracks 112; that is, other suitable articulation configurations are also contemplated.

Second linkage assembly 260 similarly includes a slide carriage including a carriage bar 264 having first and second slide feet 266 (only one slide foot 266 is illustrated) slidably engaged within slide tracks 112 of side rails 110, 120 of fixed frame assembly 100, thus enabling carriage bar 264 to slide longitudinally along fixed frame assembly 100. Second linkage assembly 260 further includes one or more linkage arms 268 pivotably coupling carriage bar 264 to thigh section 230 of movable frame assembly 200 at a position offset from the pivot axis of thigh section 230 such that sliding of carriage bar 264 longitudinally along fixed frame assembly 100 pivots the one or more linkage arms 268 to thereby articulate thigh section 230 relative to fixed frame assembly 100. In embodiments, second linkage assembly 650 includes a pair of linkage arms 268, one linkage arm disposed towards each side thereof; in other embodiments linkage arms 268 are omitted and second linkage assembly 260 is directly pivotably coupled to thigh section 230. Further, in embodiments, second linkage assembly 260 is configured to articulate thigh section 230 relative to fixed frame assembly 100 without including carriage bar 264 slidably engaged within slide tracks 112; that is, other suitable articulation configurations are also contemplated.

Carriage bars 254, 264, as demonstrated below, are configured as universal components such that a variety of different powered drive and/or manual drive assemblies may be engaged therewith to facilitate movement of movable frame assembly 200 relative to fixed frame assembly 100, e.g., between the substantially flat or lying position, the seated position, the legs raised position, and the seated and legs raised position. Thus, the desired drive assembly may be attached without the need for modifying carriage bars 254, 264 or other components of movable frame assembly 200 and without the need for tools or specialized training.

Referring still to FIGS. 1 and 2, end boards 300, 400 are positioned at the head and foot ends, respectively, of fixed frame assembly 100 and are mounted thereto via bolting, bracketing, and/or other suitable engagement of end boards 300, 400 with side rails 110, 120 and/or end rails 130, 140 of fixed frame assembly 100. Each end board 300, 400 includes a board body 310, 410 and a pair of legs 322, 324 and 422, 424 operably coupled to and extending from opposed sides of the respective board body 310, 410. Casters 332, 334 and 432, 434 are disposed at the free lower ends of legs 322, 324 and 422, 424, respectively, to enable system 10 to roll along a support surface, e.g., the floor. As an alternative to or in addition to end boards 300, 300, fixed frame assembly 100 may be supported by a pair of leg assemblies, e.g., as described in U.S. Pat. No. 8,800,080, the entire contents of which are hereby incorporated herein by reference, or in any other suitable manner via suitable end board and/or leg assemblies.

Board bodies 310, 410 house therein height adjustment mechanisms 340, 440 that operably couple board bodies 310, 410 with the respective legs 322, 324 and 422, 424 of the corresponding end board 300, 400 to enable raising or lowering of board bodies 310, 410 relative to legs 322, 324 and 422, 424, respectively, and thus, to enable raising or lowering of fixed frame assembly 100 relative to a support surface, e.g., the floor. Height adjustment mechanisms 340, 440 may include a gear and drive screw arrangement such as detailed in U.S. Pat. No. 5,134,731, the entire contents of which is hereby incorporated herein by reference, although other suitable height adjustment mechanisms 340, 440 are also contemplated.

A drive input 342, 442 of each height adjustment mechanism 340, 440 is mounted to and depends from the respective board body 310, 410. Each drive input 342, 442 includes a transmission input 344, 444 and a crank shaft input 346, 446. A transmission assembly 360 of bed system 10 including a transmission shaft 362 depends from fixed frame assembly 100 and extends between the head and foot ends thereof. Transmission shaft 362, more specifically, is directly or indirectly (e.g., via a transition box) coupled to transmission inputs 344, 444 of drive inputs 342, 442. In this manner, transmission assembly 360 is configured such that driving of one drive input 342, 442, e.g., via rotation of a crank shaft 448 engaged with one of the crank shaft input 346, 446 or via powered driving via electric motor actuator 700, similarly or oppositely drives the other drive input 342, 442 such that height adjustment is effected similarly at both ends of fixed frame assembly 100 (regardless of whether end boards 300, 400 are similar or opposite in configuration), thereby maintaining fixed frame assembly 100 in a substantially parallel orientation with a support surface, e.g., the floor. Suitable transmission components for transmission assembly 360, including mounting structures, transmission shafts, and transition boxes, are described in U.S. Pat. No. 8,424,135, the entire contents of which are hereby incorporated herein by reference, although other suitable transmission components for transmission assembly 360 are also contemplated.

Referring to FIGS. 1, 2, and 3A-3B, adjustment assemblies 500, 600 are configured as electric motor actuators 500, 600 configured to enable articulation of back section 210 and thigh section 230, respectively, of movable frame assembly 200 relative to fixed frame assembly 100. Thus, when it is desired to provide system 10 with electric articulation of back section 210 and/or thigh section 230, electric motor actuators 500 and/or 600 may be selected and installed, as detailed below.

Each actuator 500, 600 is configured as a push-pull actuator and includes an actuator base 510, 610 housing a motor 520, 620 therein and an actuator arm 530, 630 telescopically extendable/retractable under urging from motor 520, 620 and relative to actuator base 510, 610. Actuator bases 510, 610 are configured to be engaged with end rails 130, 140, respectively, of fixed frame assembly 100 via bracket and pin assemblies 540, 640, respectively, although other suitable engagement mechanisms are also contemplated, e.g., pin-hole engagement, bolt engagement, etc. Bracket and pin assemblies 540, 640 (and other suitable engagement contemplated herein) enable assembly and disassembly without the need for tools or specialized training. In embodiments, actuator bases 510, 610 are additionally or alternatively supported by one or more support brackets (not explicitly shown) depending from fixed frame assembly 100, e.g., extending transversely between side rails 110, 120.

The free ends of actuator arms 530, 630 include hardware such as one or more feet 532, 632 mounted thereto. Feet 532, 632 are configured to capture, e.g., between hardware such as flanges 533, 633 or feet 532, 632, respectively, or otherwise engage (directly or indirectly), carriage bars 254, 264, respectively, such that extension and retraction of actuator arms 530, 630 moves respective feet 532, 632 to thereby translate respective carriage bars 254, 264. Accordingly, motor 520 and/or motor 620 may be activated to drive extension or retraction of actuator arm 530 and/or actuator arm 630 a desired amount to thereby articulate back section 210 and/or thigh section 230, respectively, of movable frame assembly 200 relative to fixed frame assembly 100 to a desired position. In other embodiments, feet and/or flanges 532, 533, respectively, of actuator 500 and/or feet and/or flanges 632, 633, respectively, of actuator 600, are omitted and replaced with other suitable hardware features disposed (removably or integrally) on the free ends of actuators arms 530, 630. Such hardware features may include, for example, quick release pins, clevis pins, other suitable engagement pins, brackets, flanges, combinations thereof, etc. Additionally or alternatively, such hardware (or complementary hardware) may be disposed on carriage bars 254, 264.

Figure 3A:
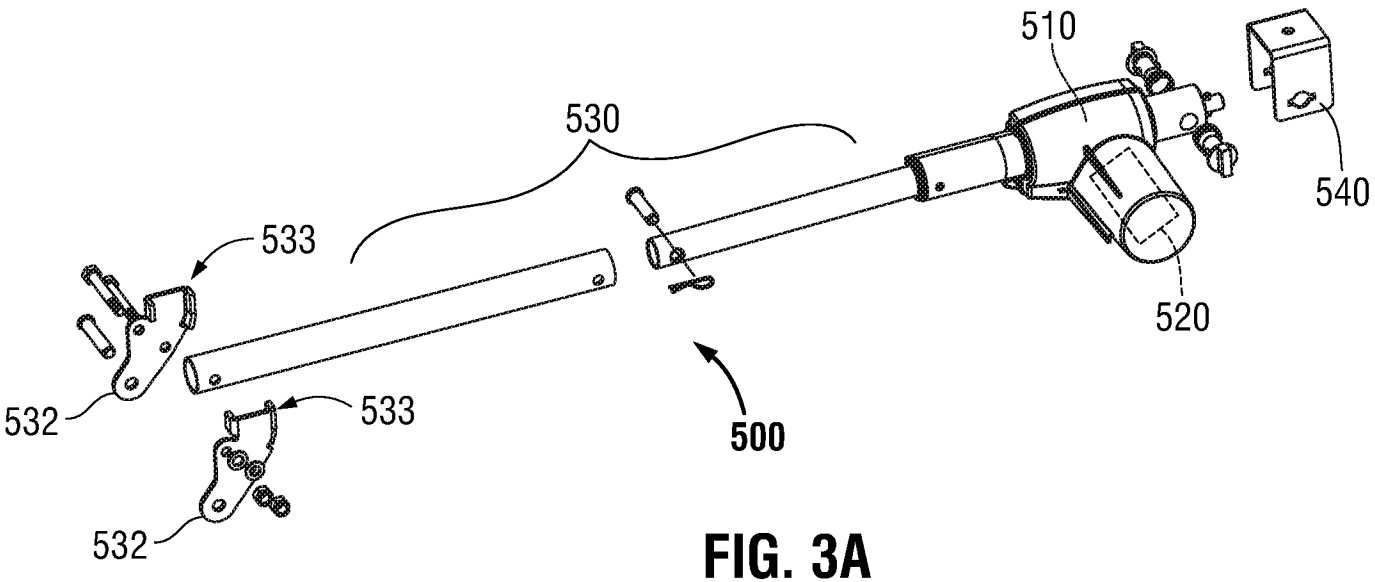
FIG. 3A is an exploded, perspective view of a first electric motor actuator of the modular adjustable bed system of FIG. 1.
Figure 3B:
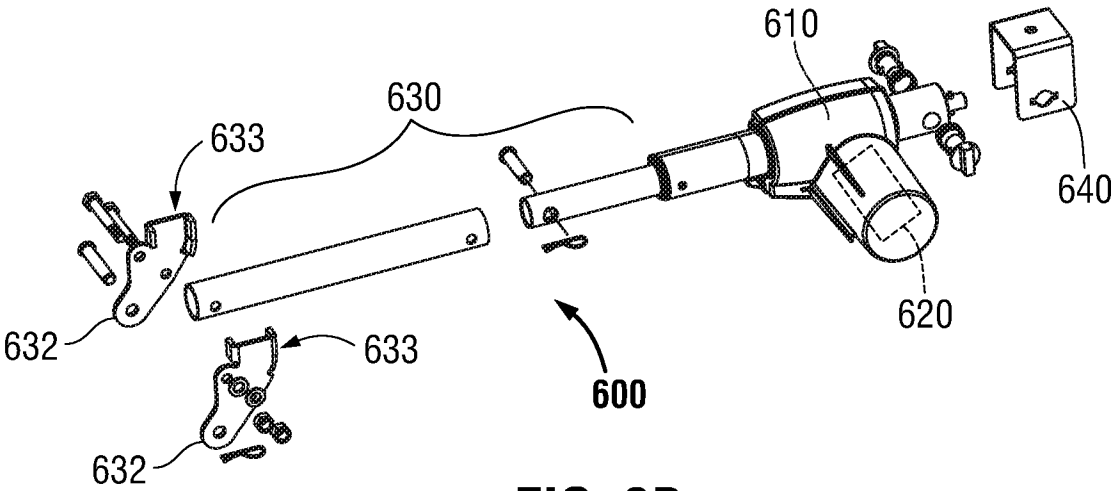
FIG. 3B is an exploded, perspective view of a second electric motor actuator of the modular adjustable bed system of FIG. 1.
Figure 8:
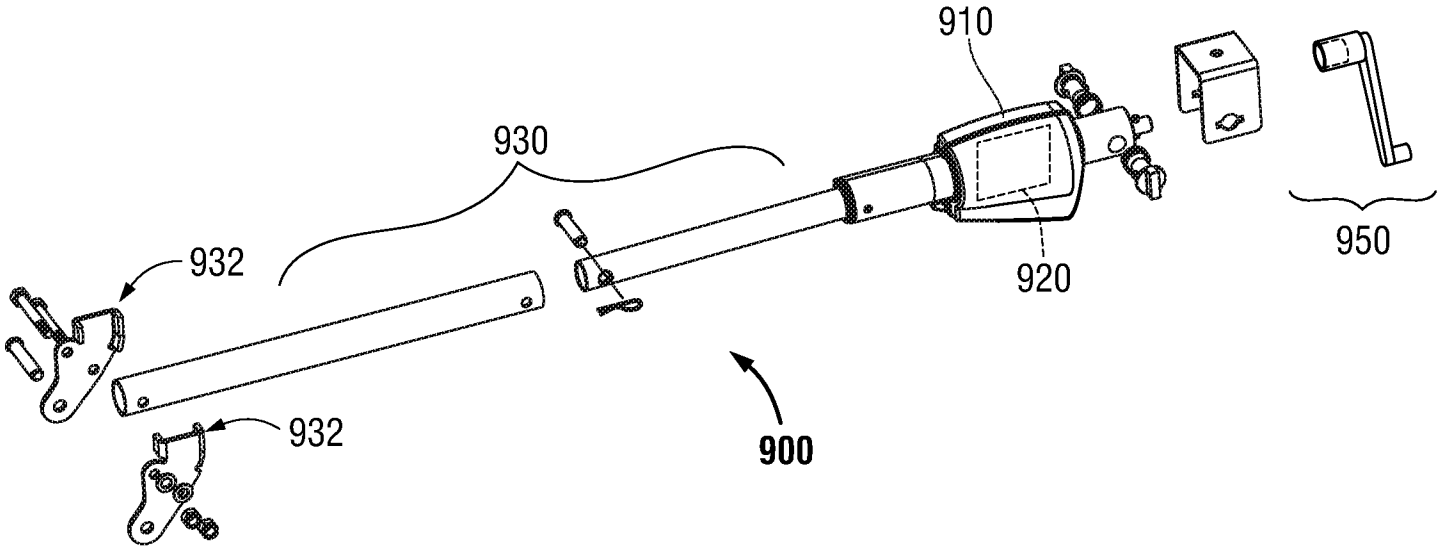
FIG. 8 is an exploded, perspective view of manual actuator configured for use with the modular adjustable bed system of FIG. 1.

With momentary reference to FIG. 8, in conjunction with FIGS. 1 and 2, a manual push-pull actuator 900 is illustrated. Manual push-pull actuator 900 is similar to electric motor actuators 500, 600 (FIGS. 3A and 3B) and one or more such manual push-pull actuators 900 may be used in place of either or both of electric motor actuators 500, 600 (FIGS. 3A and 3B) to provide manual articulation of back section 210 and/or thigh section 230, respectively, of movable frame assembly 200. Manual push-pull actuator 900 differs from actuator 500, 600 (FIGS. 3A and 3B) in that, instead of providing an electric motor, manual push-pull actuator 900 includes a gear box 920 disposed within actuator base 910. A crank arm 950 operably engaged with gear box 920 extends from actuator base 910 to enable manual cranking of gear box 920 to thereby drive extension or retraction of actuator arm 930, depending upon the direction of cranking. The feet 932 extending from the arm 930 of each manual actuator 900 are configured to engage a carriage bar 254, 264 such that each manual actuator 900 may be utilized to articulate back section 210 or thigh section 230 of movable frame assembly 200 relative to fixed frame assembly 100 to a desired position, similarly as detailed above with respect to electric motor actuators 500, 600 (FIGS. 3A and 3B), although other suitable hardware other features are also contemplated. Thus, when it is desired to provide system 10 with manual articulation of back section 210 and/or thigh section 230, manual actuator(s) 900 may be selected and installed instead of electric motor actuators 500 and/or 600 (FIGS. 3A and 3B).

Gear box 920 may provide mechanical advantage and/or amplify or attenuate the input into gear box 920 relative to the output from gear box 920. In other embodiments, gear box 920 is omitted and rotational input provided by crank arm 950 directly drives translation of actuator arm 930 relative to actuator base 910.

Figure 4:
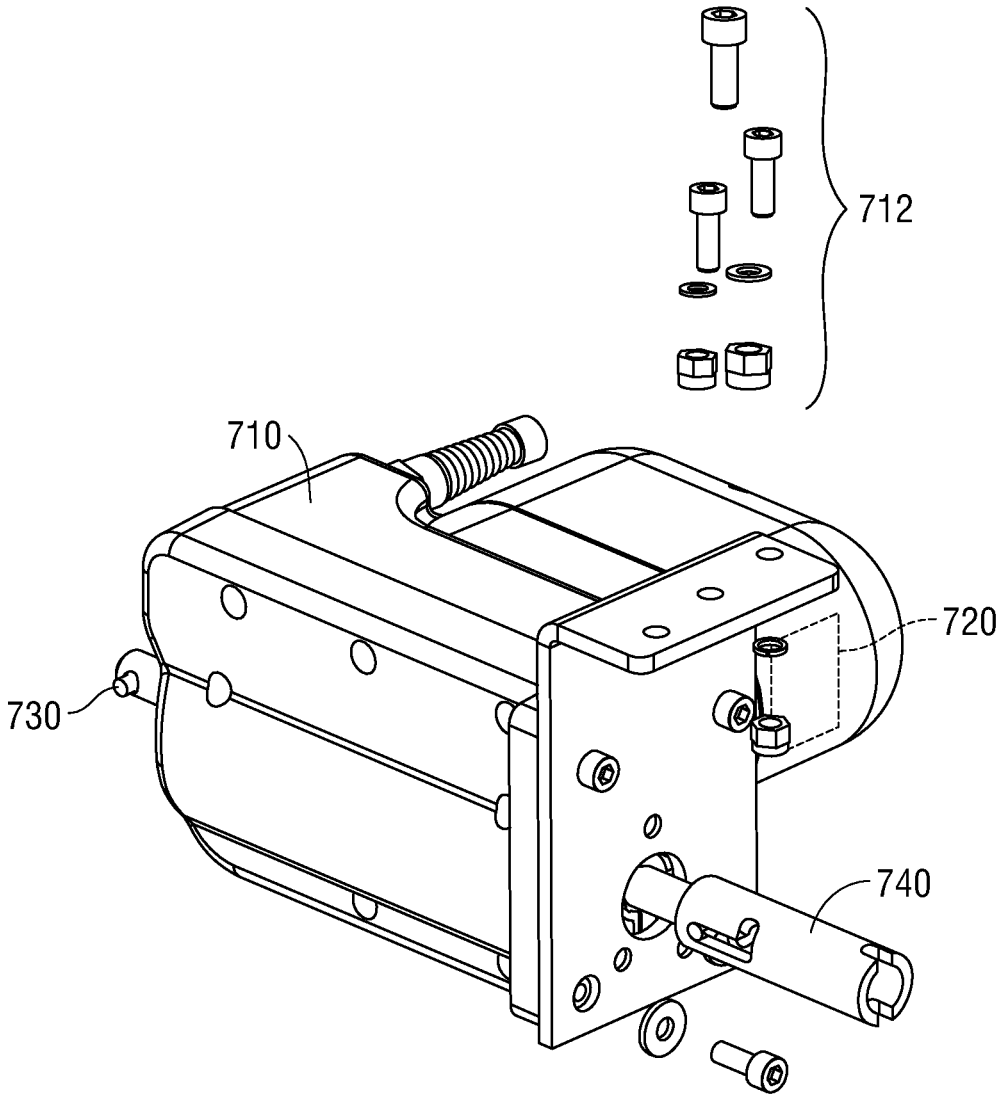
FIG. 4 is an exploded, perspective view of a third electric motor actuator of the modular adjustable bed system of FIG. 1.

Referring to FIGS. 1, 2, and 4, adjustment assembly 700 is configured as electric drive 700 configured to enable raising or lowering of fixed frame assembly 100 relative to a support surface, e.g., the floor. Thus, when it is desired to provide system 10 with electric raising or lowering of fixed frame assembly 100, adjustment assembly 700 may be selected and installed, as detailed below.

Electric drive 700 includes a housing 710, a motor 720 disposed within housing 720, and first and second output shafts 730, 740 operably coupled to motor 720 and extending form opposing ends of housing 710. Output shafts 730, 740 may be similarly coupled to motor 720 such that motor 720 drives output shafts 730, 740 to rotate in similar directions, may be oppositely coupled to motor 720 such that motor 720 drives output shafts 730, 740 to rotate in opposite directions, or may be configured to switch between similarly coupled and oppositely coupled configurations to enable motor 720 to drive output shafts 730, 740 in similar or opposite directions. In use, housing 710 of electric drive 700 is mounted on fixed frame assembly 100, e.g., via hardware 712 such as wing nuts, bolts, and/or other suitable hardware (in embodiments, hand-assembly hardware that obviating the need for tools), first output shaft 730 is operably coupled to transmission shaft 362 and second output shaft 740 is operably coupled to drive input 442 such that, when motor 720 is activated, drive input 442 is driven (directly by second output shaft 740) and drive input 342 is driven (indirectly by first output shaft 730 via transmission shaft 362) to adjust a height of fixed frame assembly 100 similarly at both ends of fixed frame assembly 100. In embodiments, housing 710 of electric drive 700 is additionally or alternatively supported by one or more support brackets (not explicitly shown) depending from fixed frame assembly 100, e.g., extending transversely between side rails 110, 120.

Figure 5:
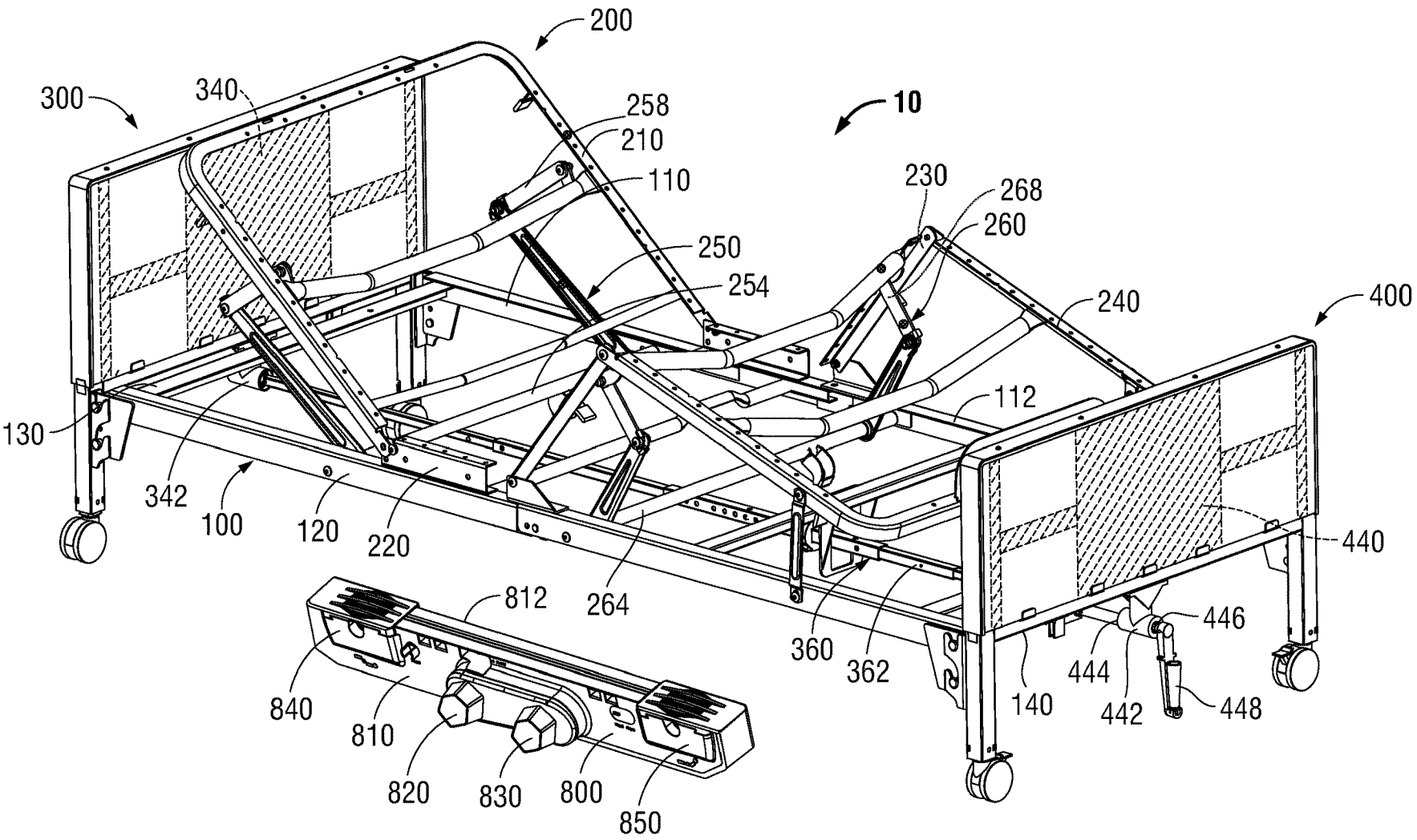
FIG. 5 is an exploded, perspective view of the modular adjustable bed system of FIG. 1, illustrated in a partially-electric configuration.
Figure 6:
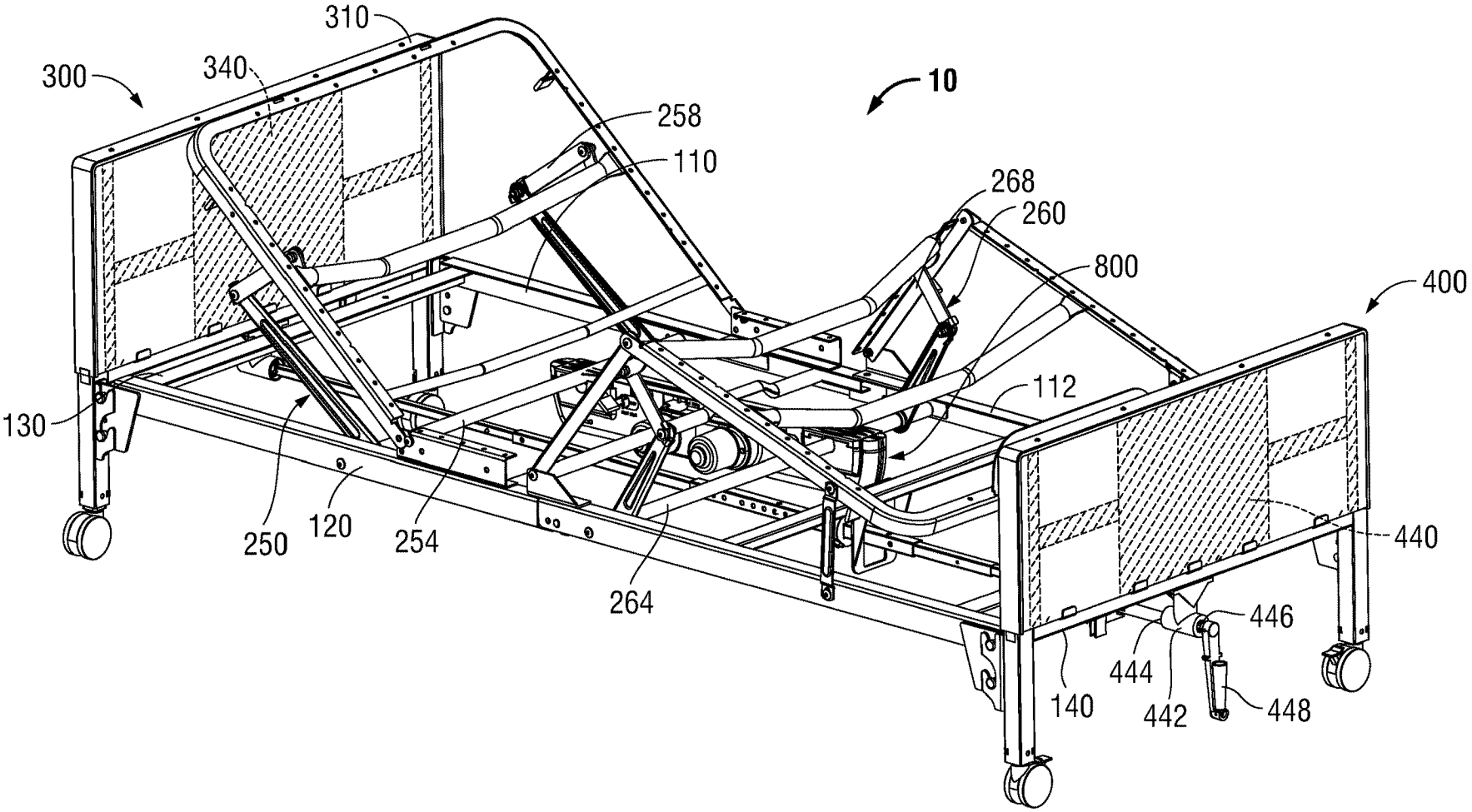
FIG. 6 is a perspective view of the modular adjustable bed system of FIG. 5, illustrated in the partially-electric configuration with a housing portion of a double electric motor actuator thereof removed.
Figure 7:
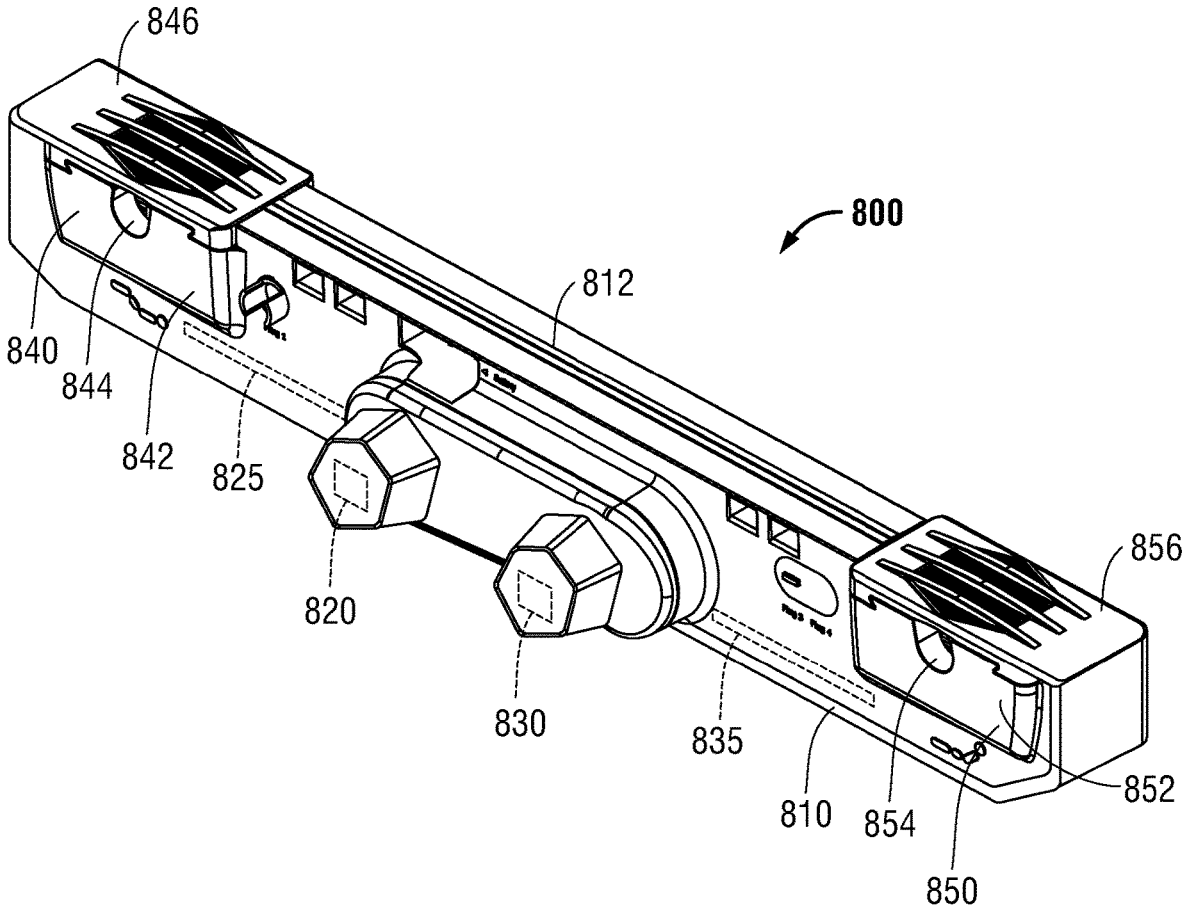
FIG. 7 is a perspective view of the double electric motor actuator of the modular adjustable bed system of FIG. 5.

With reference to FIGS. 5-7, modular adjustable bed system 10 is illustrated in a partially-electric, partially-manual configuration wherein articulation of movable frame assembly 200 is electrically-powered, while raising and lowering of fixed frame assembly 100 is manually effected. With respect to the electric-powered articulation of movable frame assembly 200 in the configuration illustrated in FIGS. 5-7, adjustment assembly 800 is provided. Adjustment assembly 800 is configured as a dual electric motor actuator 800 configured to enable articulation of back section 210 and thigh section 230, respectively, of movable frame assembly 200 relative to fixed frame assembly 100. Thus, when it is desired to provide system 10 with electric articulation of back section 210 and thigh section 230, dual electric motor actuator 800 may be selected and installed, as detailed below. Although illustrated for use in a partially-electric, partially-manual configuration, dual electric motor actuator 800 may alternatively be used as part of a fully-electric configuration; likewise, in place of dual electric motor actuator 800, electric motor actuators 500, 600 may be used as part of a partially-electric, partially-manual configuration. That is, although particular combinations are illustrated and detailed herein, any suitable combination of actuators to achieve any suitable manual, electric, or combination configuration is contemplated.

Dual electric motor actuator 800 includes a housing 810 including first and second actuators or motors 820, 830 and corresponding transmission assemblies 825, 835. Dual electric motor actuator 800 further includes first and second slide carriages 840, 850 slidably mounted on housing 810 and slidably along a guide track 812 defined on housing 810. First and second slide carriages 840, 850 are operably coupled to first and second motors 820, 830, respectively, via respective transmission assemblies 825, 835 such that actuation of motors 820, 830 drives sliding of slide carriages 840, 850, respectively, along guide track 812 of housing 810. Each slide carriage 840, 850 includes a base 842, 852 defining a transverse channel 844, 854 and a cover 846, 856 configured to releasably engage the respective base 842, 852 to close the mouth of the transverse channel 844, 854, respectively.

Dual electric motor actuator 800 is configured to engage and depend from carriage bars 254, 264. More specifically, with covers 846, 856 removed, dual electric motor assembly 800 is urged towards carriage bars 254, 264 such that posts, e.g., a portion of carriage bars 254, 264 or other suitable posts, are received within transverse channels 844, 854, respectively. Thereafter, covers 846, 856 are installed on bases 842, 852 to retain carriage bars 254, 264 within respective transverse channels 844, 854, thereby operably engaging dual electric motor assembly 800 with carriage bars 254, 264. In this engaged condition, dual electric motor assembly 800 depends from carriage bars 254, 264.

In use, motor 820 and/or motor 830 is selectively activated to slide slide carriage 840 and/or slide carriage 850 along housing 810, thereby translating carriage bar 254 and/or carriage bar 264 a desired amount to articulate back section 210 and/or thigh section 230 of movable frame assembly 200 relative to fixed frame assembly 100 to a desired position.

Referring to FIGS. 5 and 6, with respect to the manual height-adjustment of fixed frame assembly 100, transmission shaft 362 is directly or indirectly (e.g., via a transition box) coupled to transmission inputs 434, 444 of drive inputs 432, 442 without electric drive 700 (FIG. 4) disposed therebetween. Thus, in order to raise or lower fixed frame assembly 100 relative to a support surface, e.g., the floor, crank shaft 348 is manually rotated.

With general reference to FIGS. 1-8, although various configurations of system 10 utilizing various different adjustment assemblies 500-900 are described it is contemplated that system 10 may be configured with any suitably adjustment assemblies to provide a manually-operated system, an electrically-powered system, or a partially-manual, partially-electric system of any suitable configuration. Further, in embodiments, rather than direct connection and/or separate connection of the selected adjustment assemblies 500-900, one or more cradle sub-assemblies (not shown) may be utilized to facilitate operable engagement of the selected adjustment assemblies 500-900 to system 10.

Figure 9:
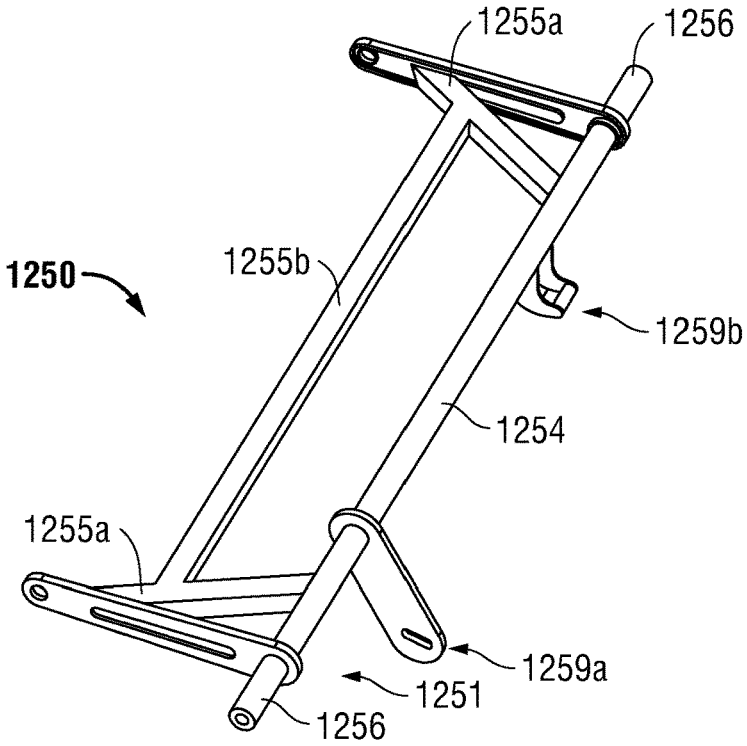
FIG. 9 is a perspective view of a first linkage assembly configured for use with the modular adjustable bed system of FIG. 1.

Turning now to FIG. 9, in conjunction with FIGS. 1-3B and 5-7, another embodiment of a first linkage assembly 1250 configured for use with modular adjustable bed system 10 is shown. First linkage assembly 1250 is similar to first linkage assembly 250 (FIGS. 1-2) and, thus, only differences therebetween are described in detail below while similarities are summarily described or omitted entirely.

First linkage assembly 1250 includes a frame 1251 and a pair of linkage arms (not shown, each similar to linkage arm 258 (FIG. 2)). Frame 1251 includes a carriage bar 1254 having first and second slide feet 1256 that are configured to slidably engage slide tracks 112 of side rails 110, 120 of fixed frame assembly 100, thus enabling frame 1251 to slide longitudinally along fixed frame assembly 100 (see FIG. 2). Frame 1251 further includes a pair of upright supports 1255*a* extending from carriage bar 1254. Each upright support 1255*a* may include one or more components (e.g., a pair of angled support bars as illustrated in FIG. 9). Upright supports 1255*a* are disposed towards opposing sides of carriage bar 1254 to define a generally U-shaped configuration therewith. However, upright supports 1255*a* are not disposed at the ends of carriage bar 1254, as the ends of carriage bar 1254 are configured to slidably engage slide tracks 112 of side rails 110, 120 of fixed frame assembly 100 (see FIG. 2), as noted above. A crossbar support 1255*b* may interconnect upright supports 1255*a* with one another at a position spaced-apart from carriage bar 1254 to provide increase structural support to frame 1251.

Upright supports 1255*a* extend from carriage bar 1254 to free ends thereof wherein upright supports 1255*a* are configured to pivotably couple to respective linkage arms (not shown, each similar to linkage arm 258 (FIG. 2)) which, in turn, are pivotably coupled to back section 210 of movable frame assembly 200 at a position offset from the pivot axis of back section 210 such that sliding of carriage bar 1254 longitudinally along fixed frame assembly 100 pivots the one or more linkage arms to thereby articulate back section 210 relative to fixed frame assembly 100 (see FIGS. 1 & 2).

First linkage assembly 1250 further includes a first connector or attachment member 1259*a* and a second connector or attachment member 1259*b*. First attachment member 1259*a* is configured to facilitate releasably attachment of an actuator of a first type, e.g., actuator 500, therewith, while second attachment member 1259*b* is configured to facilitate releasably attachment of an actuator of a second type, e.g., actuator 800, therewith. Additional attachment members are also contemplated to accommodate different types of actuators and/or other actuators may be configured to directly releasably attach to carriage bar 1254 or another portion of frame 1251.

First attachment member 1259*a*, more specifically, is configured as a plate joined to (or formed with) carriage bar 1254 towards a first end thereof and defining a slot towards a second end thereof. The attachment of first attachment member 1259*a* with actuator arm 530 of actuator 500 may be accomplished via positioning the second end of first attachment member 1259*a* between flanges 533 of feet 532 at the free end of actuator arm 530 and by inserting a pin (see FIG. 3A) through apertures defined within flanges 533 and the slot defined within first attachment member 1259*a*. Alternatively, in embodiments where flanges 533 and/or feet 532 are not provided, a slot may be defined within the free end of actuator arm 530 for receipt of attachment member 1259*a* therein (or attachment member 1259*a* may be otherwise positioned relative to actuator arm 530) such that subsequent insertion of a pin through actuator arm 530 and attachment member 1259*a* pivotably engages actuator arm 530 and attachment member 1259*a* with one another. Regardless of the particular means of attachment, this configuration enables motor 520 to be activated to drive extension or retraction of actuator arm 530 a desired amount to thereby articulate back section 210 of movable frame assembly 200 relative to fixed frame assembly 100 to a desired position. The pin-hole (e.g., slot, aperture, etc.) engagement, detailed above, facilitates the assembly and disassembly of actuator 500 with system 10 without the need for tools or specialized training.

Second attachment member 1259*b* of first linkage assembly 1250 depends from carriage bar 1254 and includes a post spaced-apart from carriage bar 1254 and mounted transversely between a pair of flanges extending from carriage bar 1254. With cover 846 of dual electric motor assembly 800 removed, the post of second attachment member 1259*b* may be inserted into transverse channel 844 and, thereafter, cover 846 installed on base to retain second attachment member 1259*b* and, thus, carriage bar 1254 in operable engagement with dual electric motor assembly 800. This configuration facilitates the assembly and disassembly of dual electric motor assembly 800 with system 10 without the need for tools or specialized training.

Figure 10:
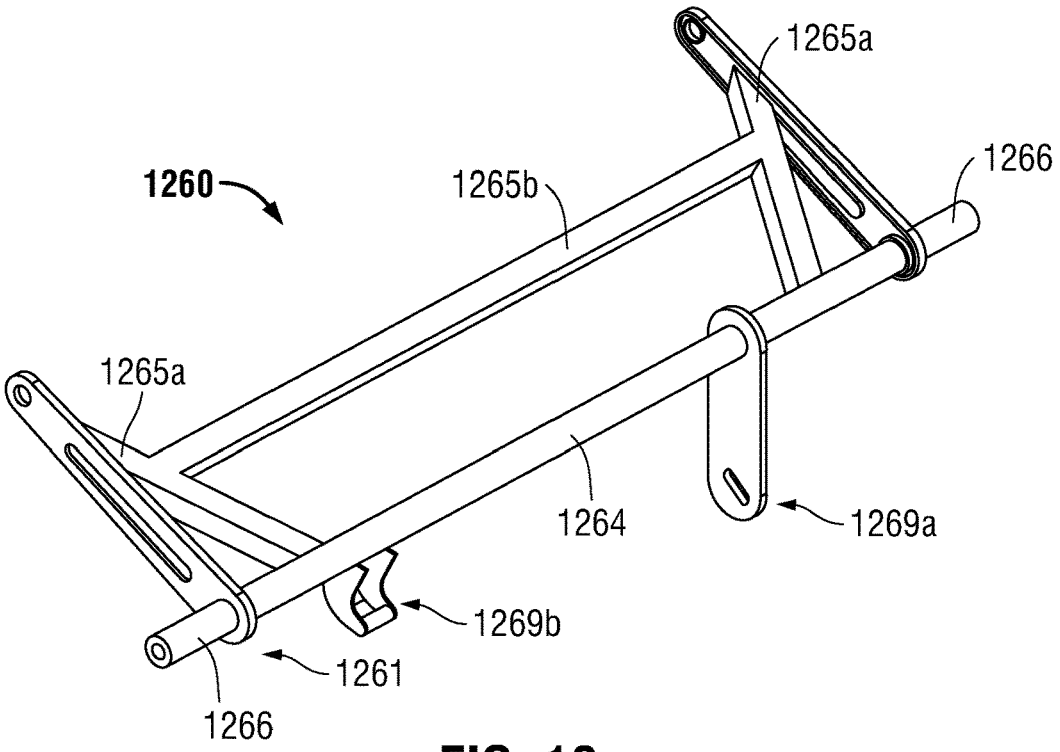
FIG. 10 is a perspective view of a second linkage assembly configured for use with the modular adjustable bed system of FIG. 1.

With reference to FIG. 10, in conjunction with FIGS. 1-3B and 5-7, another embodiment of a second linkage assembly 1260 configured for use with modular adjustable bed system 10 is shown. Second linkage assembly 1260 is similar to second linkage assembly 260 (FIG. 1) and, thus, only differences therebetween are described in detail below while similarities are summarily described or omitted entirely.

Second linkage assembly 1260 includes a frame 1261 and a pair of linkage arms (not shown, each similar to linkage arm 268 (FIG. 1)). Frame 1261 includes a carriage bar 1264 having first and second slide feet 1266 that are configured to slidably engage slide tracks 112 of side rails 110, 120 of fixed frame assembly 100, thus enabling frame 1261 to slide longitudinally along fixed frame assembly 100 (see FIG. 2). Frame 1261 further includes a pair of upright supports 1265*a* extending from carriage bar 1264. Each upright support 1265*a* may include one or more components (e.g., a pair of angled support bars as illustrated in FIG. 10). Upright supports 1265*a* are disposed towards opposing sides of carriage bar 1654 to define a generally U-shaped configuration therewith. However, upright supports 1265*a* are not disposed at the ends of carriage bar 1264, as the ends of carriage bar 1264 are configured to slidably engage slide tracks 112 of side rails 110, 120 of fixed frame assembly 100 (see FIG. 2), as noted above. A crossbar support 1265*b* may interconnect upright supports 1265*a* with one another at a position spaced-apart from carriage bar 1264 to provide increase structural support to frame 1261.

Upright supports 1265*a* extend from carriage bar 1264 to free ends thereof wherein upright supports 1265*a* are configured to pivotably couple to respective linkage arms (not shown, each similar to linkage arm 268 (FIG. 1)) which, in turn, are pivotably coupled to thigh section 230 of movable frame assembly 200 at a position offset from the pivot axis of thigh section 230 such that sliding of carriage bar 1264 longitudinally along fixed frame assembly 100 pivots the one or more linkage arms to thereby articulate back section 210 relative to fixed frame assembly 100 (see FIGS. 1 & 2).

Second linkage assembly 1260 further includes a first connector or attachment member 1269*a* and a second connector or attachment member 1269*b*. First attachment member 1269*a* is configured to facilitate releasably attachment of an actuator of a first type, e.g., actuator 600, therewith, while second attachment member 1269*b* is configured to facilitate releasably attachment of an actuator of a second type, e.g., actuator 800, therewith. Additional attachment members are also contemplated to accommodate different types of actuators and/or other actuators may be configured to directly releasably attach to carriage bar 1264 or another portion of frame 1261.

First attachment member 1269*a*, more specifically, is configured as a plate joined to (or formed with) carriage bar 1264 towards a first end thereof and defining a slot towards a second end thereof. The attachment of first attachment member 1269*a* with actuator arm 630 of actuator 600 may be accomplished via positioning the second end of first attachment member 1269*a* between flanges 633 of feet 632 at the free end of actuator arm 560 and by inserting a pin (see FIG. 3B) through apertures defined within flanges 633 and the slot defined within first attachment member 1269*a*. Alternatively, in embodiments where flanges 633 and/or feet 632 are not provided, first attachment member 1269*a* may be inserted through a slot defined within the free end of actuator arm 560 or otherwise positioned relative to the free end of actuator arm 560 to enable insertion of a pin therethrough to pivotably couple first attachment member 1269*a* with actuator arm 560. Regardless of the particular configuration, motor 620 may be activated to drive extension or retraction of actuator arm 630 a desired amount to thereby articulate thigh section 230 of movable frame assembly 200 relative to fixed frame assembly 100 to a desired position (see FIGS. 1 & 2). The pin-hole (e.g., slot, aperture, etc.) engagement, detailed above, facilitates the assembly and disassembly of actuator 600 with system 10 without the need for tools or specialized training.

Second attachment member 1269*b* of second linkage assembly 1260 depends from carriage bar 1264 and includes a post spaced-apart from carriage bar 1264 and mounted transversely between a pair of flanges extending from carriage bar 1264. With cover 856 of dual electric motor assembly 800 removed, the post of second attachment member 1269*b* may be inserted into transverse channel 854 and, thereafter, cover 856 installed on base to retain second attachment member 1269*b* and, thus, carriage bar 1264 in operable engagement with dual electric motor assembly 800. This configuration facilitates the assembly and disassembly of dual electric motor assembly 800 with system 10 without the need for tools or specialized training.

Referring to FIGS. 9 and 10, in embodiments, instead of first attachment members 1259*a*, 1269*a* being permanently joined to (or formed with) respective carriage bars 1254, 1264, first attachment members 1259*a*, 1269*a* may be releasably engagable with respective carriage bars 1254, 1264, e.g., via an engagement pin, bracket, or other suitable releasable engagement. Accordingly, when use of actuator 500 (FIG. 3A) and/or actuator 600 (FIG. 3B) is desired, first attachment members 1259*a*, 1269*a* are attached to respective carriage bars 1254, 1264. In such embodiments where first attachment members 1259*a*, 1269*a* are releasably engagable with respective carriage bars 1254, 1264, first attachment members 1259*a*, 1269*a* may also be releasably engagable with the free ends of actuator arms 530, 630, respectively, or may be permanently engaged thereto.

The modular adjustable bed system of the present disclosure thus readily enables customization of an adjustable bed for a particular purpose without requiring complex assembly (e.g., no tools or, if tools are desired, assembly with readily available, generic tools) or specialized manufacturing for each particular configuration of bed. To the extent consistent, any of the aspects and features detailed herein may be utilized with any or all of the other aspects and features detailed herein.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure.

What is claimed is:

1. A modular adjustable bed system, comprising:

a fixed frame assembly defining a head end and a foot end;

a movable frame assembly disposed on the fixed frame assembly and including at least a first movable section movable relative to the fixed frame assembly; and a first linkage assembly including a frame having first and second connectors extending therefrom and at least one linkage arm coupled between the frame and the first movable section of the movable frame assembly such that actuation of the first linkage assembly moves the first movable section relative to the fixed frame assembly, the first linkage assembly configured to releasably connect to at least two different types of first actuators to enable each of the at least two different types of first actuators to actuate the first linkage assembly, thereby moving the first movable section relative to the fixed frame assembly, the first connector of the frame of the first linkage assembly configured to connect to at least a first type of first actuator of the at least two different types of first actuators, and the second connector of the frame of the first linkage assembly configured to connect to at least a second type of first actuator of the at least two different types of first actuators.

2. The modular adjustable bed system according to claim 1, wherein at least the first type of first actuator is configured for engagement between the first connector and the fixed frame assembly.

3. The modular adjustable bed system according to claim 1, wherein one of the at least two different types of first actuators is an electric actuator and another of the at least two different types of first actuators is a manual actuator.

4. The modular adjustable bed system according to claim 1, wherein one of the at least two different types of first actuators is a first electric actuator and another of at least the two different types of first actuators is a second, different electric actuator.

5. The modular adjustable bed system according to claim 1, further comprising:

a first end board disposed at the head end of the fixed frame assembly and operably coupled thereto to enable height adjustment of the head end of the fixed frame assembly;

a second end board disposed at the foot end of the fixed frame assembly and operably coupled thereto to enable height adjustment of the foot end of the fixed frame assembly; and a transmission assembly interconnecting the first and second end boards such that height adjustment of one of the head end or the foot end effects similar height adjustment of the other of the head end or the foot end.

6. The modular adjustable bed system according to claim 5, wherein at least two different types of height adjustment actuators are configured to couple between the transmission assembly and one of the first or second end boards for height adjustment of the head and foot ends of the fixed frame assembly.

7. The modular adjustable bed system according to claim 5, wherein the at least two different types of height adjustment actuators include an electric height adjustment actuator and a manual height adjustment actuator.

8. The modular adjustable bed system according to claim 1, wherein the movable frame assembly includes a second movable section movable relative to the fixed frame assembly, and wherein the modular adjustable bed system further comprises:

a second linkage assembly operably coupled to the second movable section such that actuation of the second linkage assembly moves the second movable section relative to the fixed frame assembly, the second linkage assembly configured to releasably connect to at least two different types of second actuators to enable each of the at least two different types of second actuators to actuate the second linkage assembly, thereby moving the second movable section relative to the fixed frame assembly.

9. The modular adjustable bed system according to claim 8, wherein the second linkage assembly includes a frame having first and second connectors extending therefrom, the first connector configured to connect to at least a first type of second actuator and the second connector configured to connect to at least a second type of second actuator.

10. The modular adjustable bed system according to claim 8, wherein at least one type of first actuator and at least one type of second actuator are separate from one another.

11. The modular adjustable bed system according to claim 8, wherein at least one type of first actuator and at least one type of second actuator are coupled together as an actuator assembly.

12. A modular adjustable bed system, comprising:

a fixed frame assembly defining a head end and a foot end;

a movable frame assembly disposed on the fixed frame assembly and including at least a first movable section movable relative to the fixed frame assembly; and a first linkage assembly including a frame having: first and second connectors extending therefrom, a carriage bar configured to slide along tracks defined within the fixed frame assembly, and a pair of upright supports extending from the carriage bar to define a U-shaped configuration, wherein the first linkage assembly is operably coupled to the first movable section of the movable frame assembly such that actuation of the first linkage assembly moves the first movable section relative to the fixed frame assembly, the first linkage assembly configured to releasably connect to at least two different types of first actuators to enable each of the at least two different types of first actuators to actuate the first linkage assembly, thereby moving the first movable section relative to the fixed frame assembly, the first connector of the frame of the first linkage assembly configured to connect to at least a first type of first actuator of the at least two different types of first actuators, and the second connector of the frame of the first linkage assembly configured to connect to at least a second type of first actuator of the at least two different types of first actuators.

13. The modular adjustable bed system according to claim 12, wherein the first and second connectors extend from the carriage bar of the frame of the first linkage assembly.

14. The modular adjustable bed system according to claim 12, wherein one of the at least two different types of first actuators is an electric actuator and another of the at least two different types of first actuators is a manual actuator.

15. The modular adjustable bed system according to claim 12, wherein one of the at least two different types of first actuators is a first electric actuator and another of at least the two different types of first actuators is a second, different electric actuator.

16. The modular adjustable bed system according to claim 12, wherein the movable frame assembly includes a second movable section movable relative to the fixed frame assembly, and wherein the modular adjustable bed system further comprises:

a second linkage assembly operably coupled to the second movable section such that actuation of the second linkage assembly moves the second movable section relative to the fixed frame assembly, the second linkage assembly configured to releasably connect to at least two different types of second actuators to enable each of the at least two different types of second actuators to actuate the second linkage assembly, thereby moving the second movable section relative to the fixed frame assembly.

17. The modular adjustable bed system according to claim 16, wherein the second linkage assembly includes a frame having first and second connectors extending therefrom, the first connector configured to connect to at least a first type of second actuator and the second connector configured to connect to at least a second type of second actuator.

18. The modular adjustable bed system according to claim 16, wherein at least one type of first actuator and at least one type of second actuator are separate from one another.

19. The modular adjustable bed system according to claim 16, wherein at least one type of first actuator and at least one type of second actuator are coupled together as an actuator assembly.

20. A modular adjustable bed system, comprising:

a fixed frame assembly defining a head end and a foot end;

a movable frame assembly disposed on the fixed frame assembly and including at least a first movable section movable relative to the fixed frame assembly; and a first linkage assembly operably coupled to the first movable section such that actuation of the first linkage assembly moves the first movable section relative to the fixed frame assembly, the first linkage assembly configured to releasably connect to at least two different types of first actuators to enable each of the at least two different types of first actuators to actuate the first linkage assembly, thereby moving the first movable section relative to the fixed frame assembly, wherein one first actuator of the at least two different types of first actuators includes an engagement mechanism configured for pin-hole engagement of the one first actuator with the first linkage assembly, and wherein another first actuator of the at least two different types of first actuators includes an engagement mechanisms configured for post-channel engagement of the another first actuator with the first linkage assembly.

21. The modular adjustable bed system according to claim 20, wherein one of the at least two different types of first actuators is an electric actuator and another of the at least two different types of first actuators is a manual actuator.

22. The modular adjustable bed system according to claim 20, wherein one of the at least two different types of first actuators is a first electric actuator and another of at least the two different types of first actuators is a second, different electric actuator.

23. The modular adjustable bed system according to claim 20, wherein the movable frame assembly includes a second movable section movable relative to the fixed frame assembly, and wherein the modular adjustable bed system further comprises:

a second linkage assembly operably coupled to the second movable section such that actuation of the second linkage assembly moves the second movable section relative to the fixed frame assembly, the second linkage assembly configured to releasably connect to at least two different types of second actuators to enable each of the at least two different types of second actuators to actuate the second linkage assembly, thereby moving the second movable section relative to the fixed frame assembly.

24. The modular adjustable bed system according to claim 23, wherein the second linkage assembly includes a frame having first and second connectors extending therefrom, the first connector configured to connect to at least a first type of second actuator and the second connector configured to connect to at least a second type of second actuator.

25. The modular adjustable bed system according to claim 23, wherein at least one type of first actuator and at least one type of second actuator are separate from one another.

26. The modular adjustable bed system according to claim 23, wherein at least one type of first actuator and at least one type of second actuator are coupled together as an actuator assembly.

* * * * *